US009103238B2

(12) United States Patent
Ha et al.

(10) Patent No.: US 9,103,238 B2
(45) Date of Patent: Aug. 11, 2015

(54) CONTINUOUS VARIABLE VALVE LIFT DEVICE

(71) Applicant: Hyundai Motor Company, Seoul (KR)

(72) Inventors: Kyoung Pyo Ha, Seoul (KR); Dae Sung Kim, Hwaseong-si (KR)

(73) Assignee: HYUNDAI MOTOR COMPANY, SEOUL (KR)

( * ) Notice: Subject to any disclaimer, the term of this patent is extended or adjusted under 35 U.S.C. 154(b) by 0 days.

(21) Appl. No.: 14/137,810

(22) Filed: Dec. 20, 2013

(65) Prior Publication Data

US 2015/0059668 A1 Mar. 5, 2015

(30) Foreign Application Priority Data

Aug. 27, 2013 (KR) ..... 10-2013-0101694

(51) Int. Cl.
*F01L 1/34* (2006.01)
*F01L 13/00* (2006.01)

(52) U.S. Cl.
CPC ..... *F01L 1/34* (2013.01); *F01L 13/0021* (2013.01)

(58) Field of Classification Search
CPC ..... F01L 1/26; F01L 1/185; F01L 13/0063; F01L 13/0021; F01L 2013/0068; F01L 2013/0073
USPC ..... 123/90.16
See application file for complete search history.

(56) References Cited

U.S. PATENT DOCUMENTS

| | | | | |
|---|---|---|---|---|
| 7,469,669 | B2 * | 12/2008 | Fujita et al. | 123/90.16 |
| 7,950,362 | B2 | 5/2011 | Kim et al. | |
| 2006/0207532 | A1 * | 9/2006 | Fujita et al. | 123/90.16 |
| 2008/0168958 | A1 * | 7/2008 | Conti | 123/90.15 |
| 2009/0031971 | A1 * | 2/2009 | Kwon et al. | 123/90.16 |
| 2009/0133649 | A1 * | 5/2009 | Nowatari et al. | 123/90.17 |
| 2010/0154731 | A1 * | 6/2010 | Park | 123/90.16 |
| 2014/0299083 | A1 * | 10/2014 | Fernandez | 123/90.16 |

FOREIGN PATENT DOCUMENTS

KR 10-0957153 B1 10/2009

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A continuous variable valve lift device includes a rotatable input shaft, an input cam rotating with the input shaft, a control shaft rotatably disposed parallel to the input shaft, an input rocker mounted to, and rotatable round, the control shaft so as to be in contact with the input cam to have a torque forwarded thereto from the input cam, a control link mounted to the control shaft eccentrically, an input link having one end connected to the input rocker, a connecting rod connected between the other end of the input link and the control link, and a valve operating unit mounted to rotate as one unit with the control shaft for operating the valve, the valve operating unit having a control long hole for movably inserting the connecting rod therein, for improving the fuel consumption at a low load operation range of the engine.

19 Claims, 4 Drawing Sheets

CONTINUOUS VARIABLE VALVE LIFT DEVICE

CROSS-REFERENCE TO RELATED APPLICATION

The present application claims priority of Korean Patent Application Number 10-2013-0101694 filed Aug. 27, 2013, the entire contents of which application is incorporated herein for all purposes by this reference.

BACKGROUND OF INVENTION

1. Field of Invention

The present invention relates a variable valve lift device, and more particularly to a continuous variable valve lift device in which two intake valves are operated to have valve lift values different from each other in a low load operation range of an engine for enhancing flowability of intake introduced to a combustion chamber through the two intake valves to improve fuel consumption of the engine.

2. Description of Related Art

In general, the engine of a vehicle is provided with the combustion chamber for burning the fuel to generate power, and a valve train having intake valves each for controlling inflow of air or a mixture of the air and the fuel into the combustion chamber and exhaust valves each for controlling outflow of exhaust gas generated as the fuel burns from the combustion chamber.

And, as the intake and exhaust valves in the valve train are operated by cams interlocked with rotation of a crankshaft which is rotated by power generated by combustion of the fuel, the intake/exhaust valves opens/closes the combustion chamber, respectively.

If the cams have fixed profiles making the intake/exhaust valves to have fixed lift values respectively too, flow rates of the inflow/the outflow of the air and exhaust gas through the intake/exhaust valves are also fixedly set according to the lift values of the cams, respectively.

In the meantime, if the lift values of the intake/exhaust valves are controlled according to an operation state of the engine of the vehicle, appropriately, fuel consumption can be improved and an output of the engine can be increased. Accordingly, a variable valve lift device is suggested for controlling the lift values of the intake/exhaust valves according to the operation state of the engine.

Of the variable valve lift devices, a continuous variable valve lift device (CVVL) can devise the improvement of the fuel consumption as well as the increase of the output of the engine if the lift values of the valves are controlled within a range of 1 mm to 11 mm appropriately according on an operation range of the engine.

Of the continuous variable valve lift devices, so called an unequal continuous variable valve lift device is also disclosed in which, when the engine having the two intake valves is operated in a low load, if the two intake valves are controlled such that the valve lift values of the two intake valves are different from each other for enhancing flowability of the intake introduced to the combustion chamber through the two intake valves, thereby improving the fuel consumption of the engine.

On the unequal continuous variable valve lift devices, an unequal continuous variable valve lift structure is required, which can simplify a structure thereof and improve operation reliability.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a continuous variable valve lift device having advantages of an effective improvement of fuel consumption in a low load operation range as well as simplification of a structure thereof and improvement of operation reliability by controlling valve lift values of the two intake valves different from each other in the low load operation range of the engine.

Various aspects of the present invention provide for a continuous variable valve lift device that may include a rotatable input shaft, an input cam mounted to the input shaft to rotate therewith as one unit, a control shaft rotatably disposed parallel to the input shaft, an input rocker mounted to, and rotatable round, the control shaft so as to be in contact with the input cam to have a torque forwarded thereto from the input cam, a control link mounted to the control shaft eccentrically, an input link having one end connected to the input rocker, a connecting rod connected between the other end of the input link and the control link, and a valve operating unit mounted to rotate as one unit with the control shaft for operating the valve, the valve operating unit having a control long hole for movably inserting the connecting rod therein.

The valve may include at least two intake valves for controlling intake inflowing to the engine.

The valve operating unit may include at least two output rockers for operating at least two intake valves respectively, wherein the at least two output rockers have control long holes formed to have shapes different from each other.

The output rocker may have an assemble hole formed therein for pass through of the control shaft, and the control long hole may have a rectangular shape with rounded corners formed at a position spaced from the assemble hole.

The control long hole may be formed parallel to a horizontal center line of the assemble hole, with a curved surface formed at a portion thereof.

The control long hole may have a fore end thereof formed slanted toward the horizontal center line of the assemble hole.

The control long hole may have a fore end thereof formed slanted in a direction moving away from the horizontal center line of the assemble hole.

The control long hole may have a fore end thereof formed slanted in a direction moving away from the horizontal center line of the assemble hole, with a curved surface formed at a portion thereof.

The input shaft may be a cam shaft rotated as a torque is forwarded thereto from the engine.

The input rocker may include a roller in contact with the input cam.

Various aspects of the present invention provide for a continuous variable valve lift device that may include a rotatable input shaft, an input cam mounted to the input shaft to rotate therewith as one unit, a control shaft rotatably disposed parallel to the input shaft, an input rocker mounted to, and rotatable round, the control shaft so as to be in contact with the input cam to have a torque forwarded thereto from the input cam, a control link mounted to the control shaft eccentrically, an input link having one end connected to the input rocker, a connecting rod connected between the other end of the input link and the control link, and a first output rocker having a control long hole the connecting rod is movably inserted thereto, the first output rocker mounted to the control shaft to rotate as one unit with the control shaft for rotating the valve, a second output rocker having a control long hole the connecting rod is movably inserted thereto, the second output rocker mounted to the control shaft to rotate as one unit with the control shaft for rotating the valve, and an output link having one end connected to the second rocker and the other end having the connecting rod coupled thereto passed therethrough.

The valve may include at least two intake valves for controlling intake inflowing to the engine.

The first output rocker may have an assemble hole formed therein for pass through of the control shaft, and the control long hole may have a rectangular shape with rounded corners formed at a position spaced from the assemble hole.

The control long hole is formed parallel to a horizontal center line of the assemble hole, with a curved surface formed at a portion thereof.

The control long hole may have a fore end thereof formed slanted toward the horizontal center line of the assemble hole.

The control long hole may have a fore end thereof formed slanted in a direction moving away from the horizontal center line of the assemble hole.

The control long hole may have a fore end thereof formed slanted in a direction moving away from the horizontal center line of the assemble hole, with a curved surface formed at a portion thereof.

The input shaft may be a cam shaft rotated as a torque is forwarded thereto from the engine.

The input rocker may include a roller in contact with the input cam.

The continuous variable valve lift device in accordance with various aspects of the present invention can improve the fuel consumption of the engine effectively as at least two intake valves which control intake inflowing to the combustion chamber of the engine are operated to have the valve lift values different from each other in the low load operation range of the engine, enhancing flowability of the intake in the combustion chamber flowed to the combustion chamber of the engine through at least two intake valves in the low load operation range of the engine.

The continuous variation of the at least two intake valves permits to embody optimum fuel consumption.

The simple structure of the continuous variable valve lift device of the present invention permits to apply to the present continuous variable valve lift apparatus easily, and to obtain excellent operation reliability.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
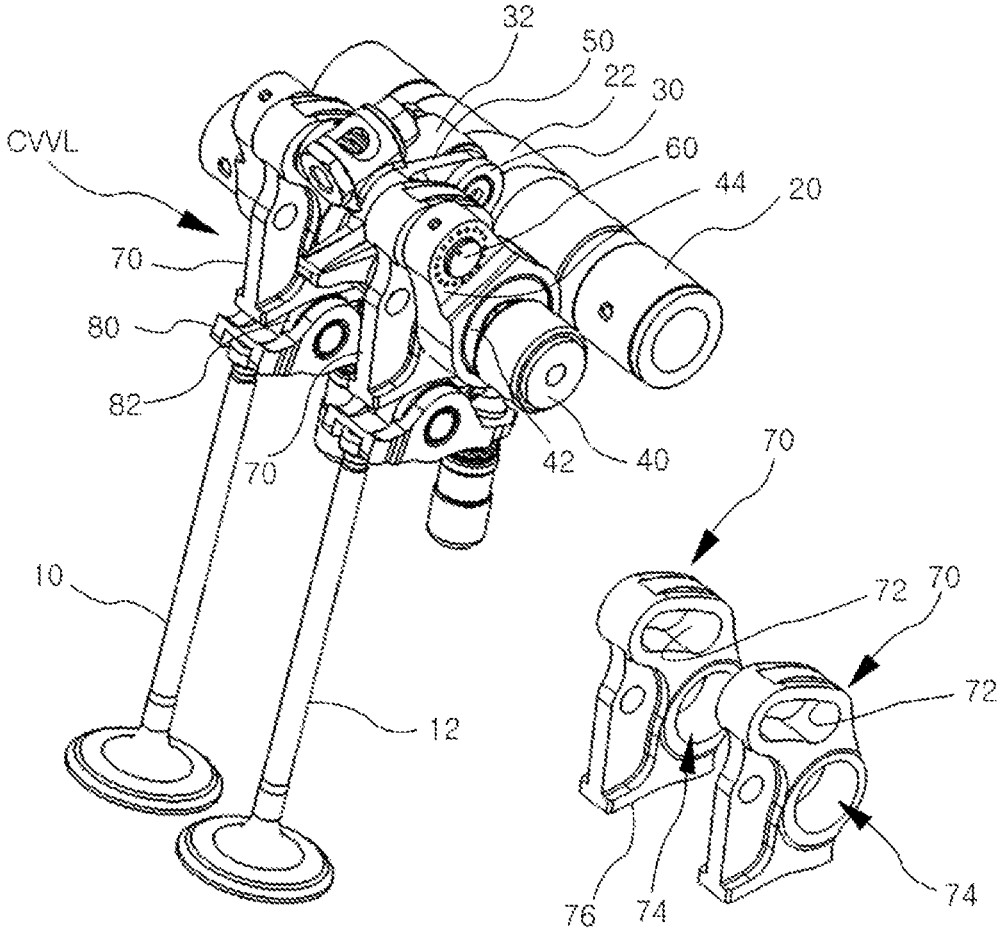
FIG. 1 illustrates a schematic view of a configuration of an exemplary continuous variable valve lift device in accordance with the present invention.

Referring to FIG. 1, the continuous variable valve lift device (CVVL) in accordance with various embodiments of the present invention may be applied to an engine having at least two first and second intake valves 10 and 12.

The continuous variable valve lift device (CVVL) in accordance with various embodiments of the present invention may have a cam (Input cam 22) mounted to rotate as one unit with a camshaft (Input shaft) 20 which rotates as rotation power is forwarded thereto from the engine according to drive of the engine.

The cam 22 may be mounted such that a roller 32 of an input rocker 30 is in contact with the cam 22, and the input rocker 30 may be inserted on an outside circumference of a control shaft 40 to rotate round the control shaft 40.

The input rocker 30 may have one end of an input link 50 connected thereto to be interlocked therewith, the control shaft 40 may have an eccentric cam 42 mounted to an outside circumference thereof to rotate as one unit therewith, and the eccentric cam 42 may have a control link 44 mounted to an outside circumference thereof to rotate as one unit therewith.

Since the control link 44 has a connecting rod 60 mounted thereto passed therethrough and the input link 40 has the connecting rod 60 mounted thereto passed through the other end thereof, the control link 44 and the input link 50 may be connected to each other with the connecting rod 60.

The output rocker 70 has one end having a control long hole 72 formed therein, the control long hole 72 has the connecting rod 60 placed therein passed therethrough, the output rocker 70 has one side portion having an assemble hole 74 formed therein passed therethrough to mount the control shaft 40 thereto passed therethrough, and the output rocker 70 has the other end having a shoe 76 formed thereon which may be mounted to be in contact with a roller 82 of a roller finger follower 80.

The roller finger follower 80 may have one end having one end of the intake valve 10 inserted therein to couple thereto.

Consequently, if the camshaft 20 and the cam 22 rotate as power is forwarded thereto from the engine, the input rocker 30 rotates round the control shaft 40 through the roller 32 in contact with the cam 22, the rotation of the input rocker 30 is forwarded to the output rocker 70 through the input link 50, such that the output rocker 70 pushes the roller finger follower 80 while rotating round the control shaft 40, to open the intake valve 10.

In the meantime, if the control shaft 40 rotates under the control of a controller, to rotate the eccentric cam 42 as one unit therewith, which rotates the control link 44 at a predetermined angle, the rotation of the control link 44 varies a position of the connecting rod 44 inserted in the control long hole 72 in the output locker 70, to vary a valve lift value of the intake valve 10.

That is, if the position of the connecting rod 44 varies within the control long hole 72, the valve lift value varies.

Figure 2:
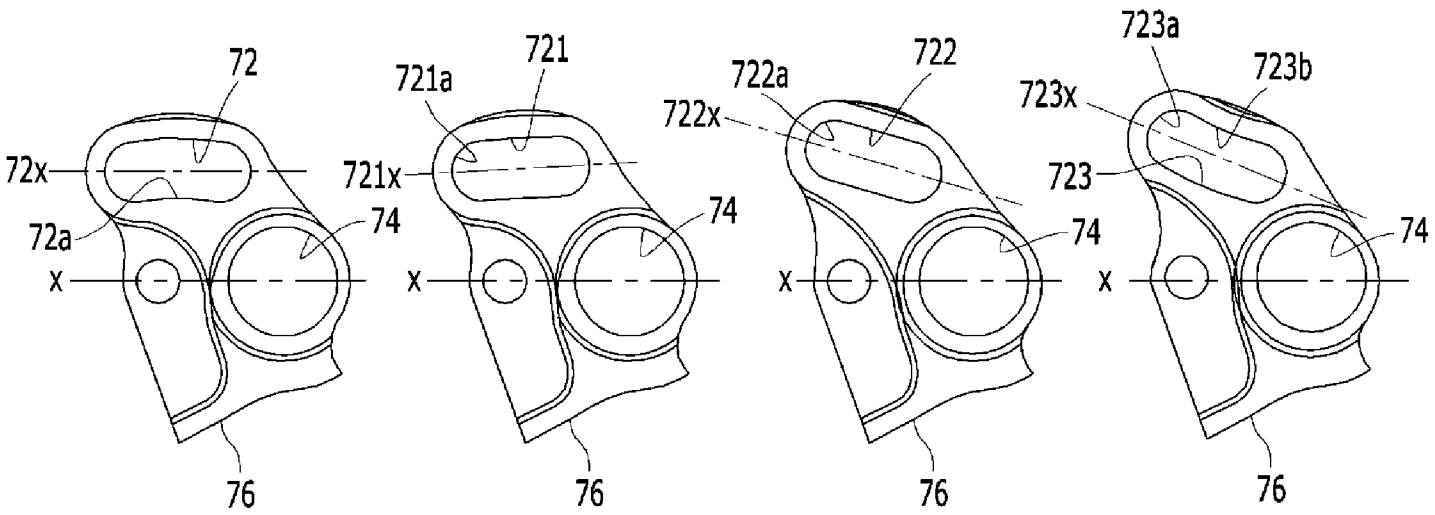
FIG. 2 illustrates schematic views of exemplary output rockers respectively having different control long holes in accordance with the present invention.

Referring to FIG. 2, though profiles of the shoes 70 of the output rockers are identical, the control long holes may have different shapes.

That is, a first control long hole 72 has a rectangular shape with round corners substantially, with a horizontal center line 72X parallel with a horizontal center line X of the assemble hole 74, with the first control long hole 72 has a curved surface 72*a* formed at a portion thereof.

A second control long hole 721 has a rectangular shape with round corners substantially, with a fore end portion 721*a* slanted toward the horizontal line X of the assemble hole 74 such that the horizontal center line 721X of the second long hole 721 may cross the horizontal center line X of the assemble hole 74.

A third control long hole 722 has a rectangular shape with round corners substantially, with a fore end portion 722*a* slanted in a direction moving away from the horizontal line X of the assemble hole 74 such that the horizontal center line 722X of the third control long hole 722 may cross the horizontal center line X of the assemble hole 74.

A fourth control long hole 723 has a rectangular shape with round corners substantially, with a fore end portion 723*a* slanted in a direction moving away from the horizontal line X of the assemble hole 74 such that the horizontal center line 723X of the fourth control long hole 723 may cross the horizontal center line X of the assemble hole 74, with the fourth control long hole 723 has a curved surface 723*b* formed at a portion thereof.

If shapes of the control long holes of the output rockers 70 which respectively operate the two intake valves 10 are made different from each other, the valve lift values of the two intake valves 10 may be controlled different from each other.

For an example, if one side output locker 70 which operates an one side first intake valve 10 has a first control long hole 72, and the other side output locker 70 which operates the other side output locker 70 which operates the other side second intake valve 12 has a second control long hole 721, the first intake valve 10 and the second intake valve 12 may have the valve lift values different from each other in a particular lift mode.

Figure 3:
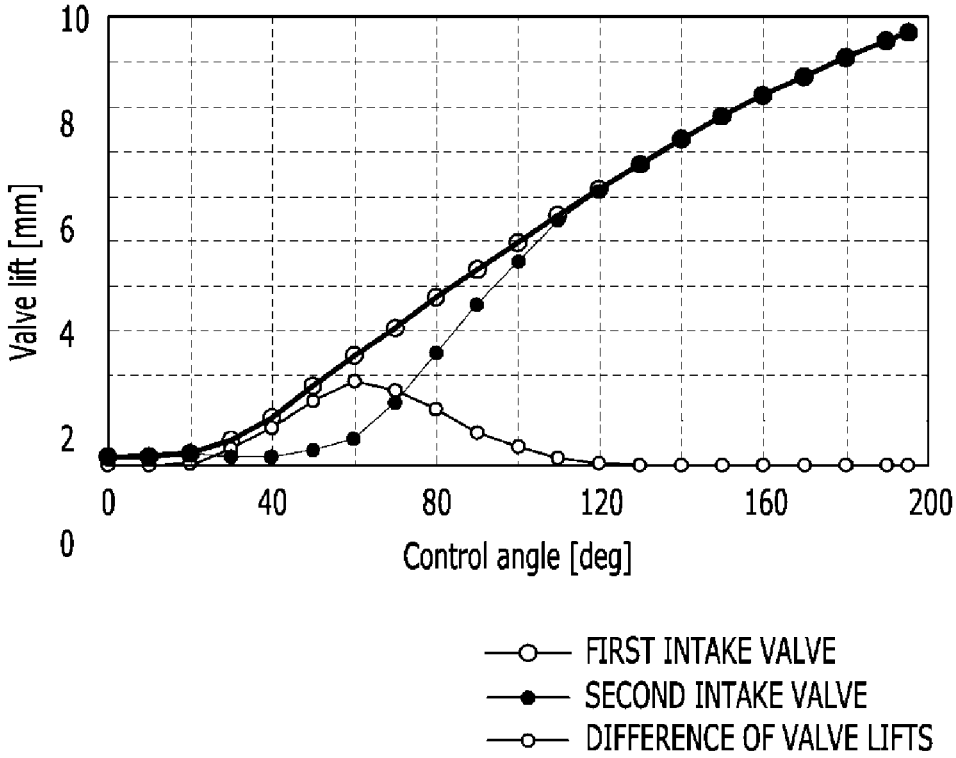
FIG. 3 illustrates a graph showing a valve lift value vs. a control angle of an exemplary continuous variable valve lift device in accordance with the present invention.

Referring to FIG. 3, the first intake valve 10 and the second intake valve 12 may have the valve lift values different from each other owing to the control long holes having shapes different from each other according to a rotation angle (control angle) of the control shaft 40. Particularly, by making the first intake valve 10 and the second intake valve 12 to have the valve lift values different from each other in a low lift mode, the fuel consumption may be improved effectively in a low load range of the engine, and by making the first intake valve 10 and the second intake valve 12 to have the valve lift values almost same with each other in a high lift mode, increase of the output may be devised.

Figure 4:
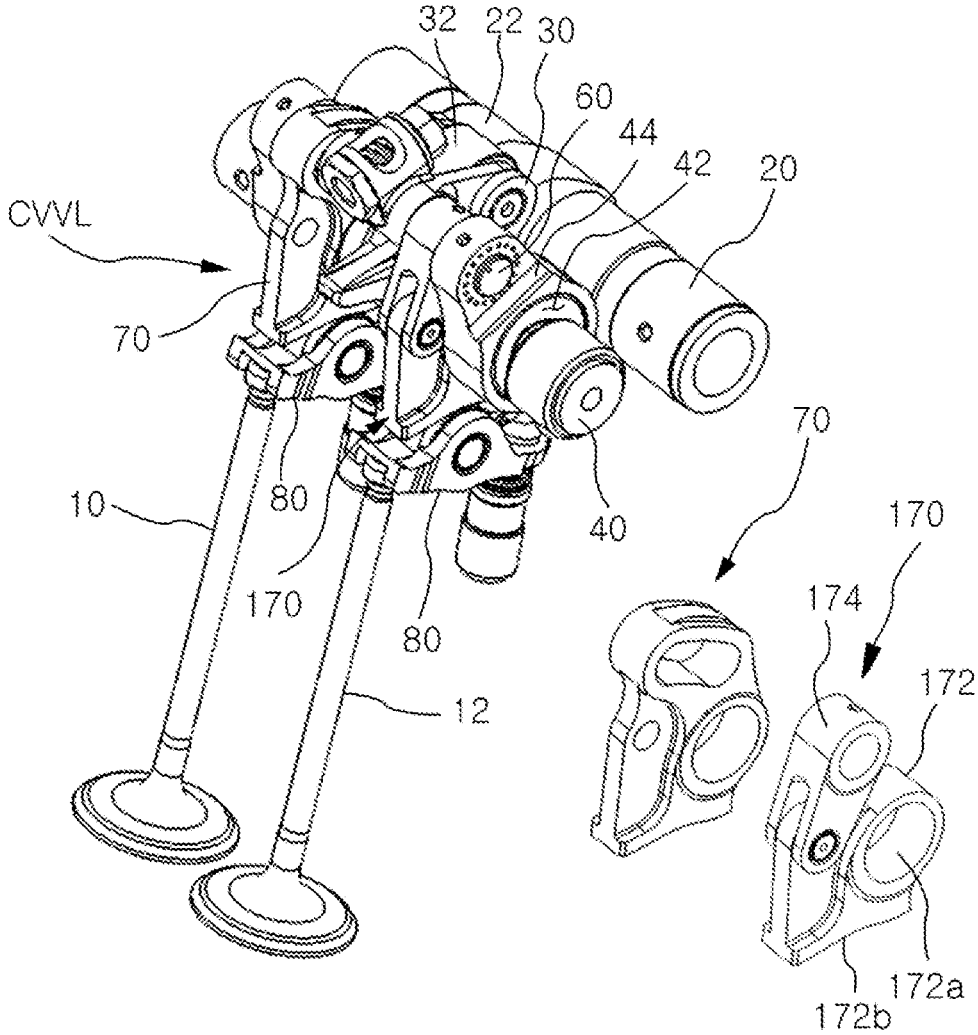
FIG. 4 illustrates a schematic view of a configuration of an exemplary continuous variable valve lift device in accordance with the present invention.

Referring to FIG. 4, the first intake valve 10 may have the output rocker 70 described before disposed thereto, while the second intake valve 12 may have a valve operating unit 170 having a structure different from the output rocker 70 disposed thereto.

The valve operating unit 170 may include a second output rocker 172 mounted to couple to the control shaft 40 to rotate as one unit therewith as well as to be in contact with the roller 82 of the roller finger follower 80, and an output link 174 having one end connected to the second output rocker 172 with a pin, and the other end having the output link 174 the connecting rod 60 is coupled thereto passed therethrough.

The second output rocker 172 may include an assemble hole 172*a* having the control shaft 40 inserted therein to assemble therewith, and a shoe 172*b* in contact with the roller 82 of the roller finger follower 80.

Sine above configuration enables the valve lift value of the first intake valve 10 different from the valve lift value of the second intake valve in the low lift mode, the improvement of the engine can be devised.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve lift device comprising:

a rotatable input shaft;

an input cam mounted to the input shaft to rotate therewith as one unit;

a control shaft rotatably disposed parallel to the input shaft;

an input rocker mounted to, and rotatable about, the control shaft in contact with the input cam to receive a torque from the input cam;

a control link eccentrically mounted to the control shaft;

an input link having one end connected to the input rocker;

a connecting rod connected between an other end of the input link and the control link; and a valve operating unit mounted to rotate as one unit with the control shaft for operating the valve, the valve operating unit having a control long hole for movably inserting the connecting rod therein.

2. The device of claim 1, wherein the valve includes at least two intake valves for controlling intake inflowing to the engine.

3. The device of claim 2, wherein the valve operating unit includes at least two output rockers for operating at least two intake valves respectively, wherein the at least two output rockers have control long holes formed to have shapes different from each other.

4. The device of claim 3, wherein the output rocker has an assemble hole formed therein for pass through of the control shaft, and the control long hole has a rectangular shape with rounded corners formed at a position spaced from the assemble hole.

5. The device of claim 4, wherein the control long hole is formed parallel to a horizontal center line of the assemble hole, with a curved surface formed at a portion thereof.

6. The device of claim 4, wherein the control long hole has a fore end thereof formed slanted toward the horizontal center line of the assemble hole.

7. The device of claim 4, wherein the control long hole has a fore end thereof formed slanted in a direction moving away from the horizontal center line of the assemble hole.

8. The device of claim 4, wherein the control long hole has a fore end thereof formed slanted in a direction moving away from the horizontal center line of the assemble hole, with a curved surface formed at a portion thereof.

9. The device of claim 2, wherein the input shaft is a cam shaft rotated as a torque is forwarded thereto from the engine.

10. The device of claim 2, wherein the input shaft is a cam shaft rotated as a torque is forwarded thereto from the engine.

11. The device of claim 1, wherein the input rocker includes a roller in contact with the input cam.

12. A continuous variable valve lift device comprising:

a rotatable input shaft;

an input cam mounted to the input shaft to rotate therewith as one unit;

a control shaft rotatably disposed parallel to the input shaft;

an input rocker mounted to, and rotatable about, the control shaft in contact with the input cam to receive a torque from the input cam;

a control link eccentrically mounted to the control shaft;

an input link having one end connected to the input rocker;

a connecting rod connected between another end of the input link and the control link; and a first output rocker having a control long hole the connecting rod is movably inserted thereto, the first output rocker mounted to the control shaft to rotate as one unit with the control shaft for rotating the valve;

a second output rocker mounted to the control shaft to rotate as one unit with the control shaft for rotating a second valve; and an output link having one end connected to the second rocker and the another end having the connecting rod coupled thereto passed therethrough.

13. The device of claim 12, wherein the valve includes at least two intake valves for controlling intake inflowing to the engine.

14. The device of claim 13, wherein the first output rocker has an assemble hole formed therein for pass through of the control shaft, and the control long hole has a rectangular shape with rounded corners formed at a position spaced from the assemble hole.

15. The device of claim 14, wherein the control long hole is formed parallel to a horizontal center line of the assemble hole, with a curved surface formed at a portion thereof.

16. The device of claim 14, wherein the control long hole has a fore end thereof formed slanted toward the horizontal center line of the assemble hole.

17. The device of claim 14, wherein the control long hole has a fore end thereof formed slanted in a direction moving away from the horizontal center line of the assemble hole.

18. The device of claim 14, wherein the control long hole has a fore end thereof formed slanted in a direction moving away from the horizontal center line of the assemble hole, with a curved surface formed at a portion thereof.

19. The device of claim 12, wherein the input rocker includes a roller in contact with the input cam.

* * * * *